US005863617A

United States Patent [19]

Piontek

[11] Patent Number: 5,863,617

[45] Date of Patent: Jan. 26, 1999

[54] PORTABLE METAL BONDED ANTI-SLIP COATING APPLICATION PROCESS

[75] Inventor: Eugene A. Piontek, Nashville, Tenn.

[73] Assignee: Harsco Technologies Corporation, Camp Hill, Pa.

[21] Appl. No.: 915,777

[22] Filed: Aug. 21, 1997

[51] Int. Cl.[6] ..... B05D 1/08

[52] U.S. Cl. ..... 427/449; 427/203; 427/205; 427/299; 427/328; 427/405; 427/406; 427/419.2; 427/419.3; 427/422; 427/427; 427/454; 427/455; 427/456; 427/580

[58] Field of Search ..... 427/449, 454, 427/455, 456, 580, 203, 205, 299, 328, 405, 406, 419.2, 419.3, 422, 427

[56] References Cited

U.S. PATENT DOCUMENTS 3,855,444 12/1974 Palena .
4,029,852 6/1977 Palena .
4,961,973 10/1990 Molnar .
5,077,137 12/1991 Molnar .

*Primary Examiner*—Bernard Pianalto
*Attorney, Agent, or Firm*—Eckert Seamans Cherin & Mellott

[57] ABSTRACT

A method for applying a rough slip resistant non-skid surface to a substrate in the field at the cite of use, comprising applying at least one base coat of metal to a surface of the substrate; wetting the surface of the substrate with a surfactant; spreading grit onto the wetted surface of the substrate; applying at least one bond coat of metal over the grit and the substrate, locking the grit in place; and, applying at least one finish coat of metal over the grit and the substrate.

22 Claims, No Drawings

PORTABLE METAL BONDED ANTI-SLIP COATING APPLICATION PROCESS

FIELD OF THE INVENTION

This invention relates to a method for applying a slip resistant non-skid surface to a substrate. More particularly, the method of the invention provides a means by which a slip resistant non-skid surface may be applied to a substrate in the field at the site of use.

BACKGROUND OF THE INVENTION

Substrates having a rough slip resistant non-skid surface are employed as floors, foot walks, stairways, ladders, scaffolding, platforms, and all areas where people may stand or walk. Such non-skid surfaces may be produced by bonding abrasive material or particles of grit to a metal or other backing material adapted to be bolted or secured in place to receive and resist wear.

U.S. Pat. No. 3,855,444 ("Palena") discloses and claims a method by which a rough non-skid coating is applied to a substrate. Particularly, Palena teaches a method by which a grit or non-skid material is bonded with a metal to the surface of a substrate. The Palena patent, however, is particularly directed to a method for constructing aircraft landing mats in a production facility wherein the substrate is passed on a conveyor beneath a series of electric arc metal spray apparatus. Specifically, Palena teaches a process whereby a clean, dry metal panel or mat is covered with loose grit. The layer of loose grit is then preliminarily locked or bonded to the metal mat by a low velocity spray of molten metal droplets from an arc metal spray apparatus. After being preliminarily locked or bonded to the metal mat, a finish coat of relatively high velocity, molten metal is deposited onto the surface of the mat over the grit.

The Palena process, however, has been limited to use in production facilities. The metal panels treated by the Palena process to impart a non-skid surface to the panels in such facilities were then bolted in place at the site of use. The non-skid surface which eventually wears out with use, must periodically be reapplied. The current practice is to remove the non-skid panels from service and ship them back to the production facility where a new non-skid surface may be applied to the metal panels. The re-treated metal panels are then shipped back to the site of use for reinstallation.

The need to perform the non-skid surface application process in a production facility results in added costs for removal and shipment of worn panels for retreatment. Also, spare panels must be provided for use while other panels are being retreated. Otherwise the walkway or other facilities must be taken out of service while the worn panels are retreated. All of which amounts in increased cost.

Additionally, the metal panels for use in the Palena process are necessarily limited in size such that they may be handled at the production facility and shipped to the site of use for installation.

What is needed is a process whereby a rough slip resistance non-skid surface having all of the benefits of the non-skid surface provided by Palena may be applied to a substrate in the field at the site of use.

SUMMARY OF THE INVENTION

We have now discovered a method whereby a rough slip resistant non-skid surface may be applied to a substrate in the field at the site of use of the substrate.

It is an object of the invention to provide a method of applying a rough slip resistant non-skid surface to a substrate in the field at the site of use of the substrate.

It is another object of the invention to provide a method of applying a rough slip resistant non-skid surface to a substrate wherein the surface area of the substrate to be treated may be unlimited in size.

It is another object of the invention to provide a method of applying a rough slip resistant non-skid surface to a substrate made of a material selected from the group comprising metal, fabric, plastic, and concrete.

It is another object of the invention to provide a method of applying a rough slip resistant non-skid surface to a substrate in the field wherein a surfactant is deposited onto the substrate before the application of the grit material.

In one preferred embodiment of the invention, the method of applying a rough slip resistant non-skid surface to a substrate in the field at the site of use, comprises:

(a) cleaning the surface of the substrate;

(b) roughening the surface of the substrate;

(c) manually applying at least one base coat of metal to the substrate;

(d) manually wetting the surface of the substrate with a surfactant;

(e) manually spreading grit onto the wetted surface of the substrate;

(f) manually applying at least one bond coat of metal over the grit and the substrate, locking the grit in place; and, (g) manually applying at least one finish coat of metal over the grit and the substrate.

DETAILED DESCRIPTION OF THE PREFERRED EMBODIMENTS OF THE INVENTION

The following detailed description is of the best presently contemplated mode of carrying out the invention. The description is not intended in a limiting sense, and it is made solely for the purpose of illustrating the general principles of the invention. The various features and advantages of the present invention may be more readily understood with reference to the following detailed description.

The invention is briefly, bonding a grit or non-skid material to a substrate with a metal. In the most general terms, the steps taken are to prepare the surface of the substrate to be coated by any cleaning method available to remove dirt acid or grease, such as soap solutions with wetting agents, steam or degreasing agents. Then the surface is roughened by grit blasting or any other roughening technique. A base coat of metal is deposited on the substrate. For example, a hand held electric arc metal spray apparatus of conventional construction may be used to deposit a base coat of metal on the substrate. A conventional electric arc metal spray apparatus uses electricity to create an arc which in turn melts metal wire fed to the apparatus and pressurized gas, e.g., pressurized air, is used to project the molten metal toward the desired target, in this case the substrate. The size of the wire, the wire feed rate, the gas pressure, the amperage and the voltage are all operating parameters for the spray apparatus which may be varied to suit the specific conditions. Contrary to the conventional practice of applying grit to a clean dry substrate, under the invention the surface of the substrate is wetted with a surfactant. The substrate is then covered with a layer of grit. The surfactant aids in adhering the loose grit to the substrate. Such aid is important in the field application of a non-skid surface to help hold the grit on the substrate until and during the application of a bond coat of metal over the grit. Again, for example, a hand held electric arc metal spray apparatus of conventional construction may be used to deposit the bond coat of metal to the substrate. The gas pressure and hence its velocity and the amperage applied in the arc are reduced from normal levels, as is described in greater detail below, and the distance between the arc spray apparatus and the substrate is greater than normal during the application of the bond coat. The purpose of these departures from the conventional settings is to provide certain conditions of impact on the work surface. Specifically, the process conditions are selected so that the metal droplets impinging on the substrate are in a softened or molten state, but not vaporized. Furthermore, the velocity of the gas at the point of impact with the grit should be such that the grit is not significantly blown around or swept off the substrate. In this respect, the surfactant helps adhere the grit to the substrate during the application of the bond coat.

It has been found that if the droplets of molten metal impinging on the grit are too hot, undesirable splattering will occur. Accordingly, the temperature of the sprayed metal fragments or droplets must be low enough so that splattering does not occur. Additionally, the temperature of the substrate should be at least 15° C. during the application of the bond coat.

After the bond coating step, a finish coat is applied. For example, a conventional hand held electric arc metal spray apparatus may be used to apply metal in the conventional manner for surface application of electric arc sprayed materials. That is, in practice, the gas pressure is raised, the current is raised, and the arc is brought closer to the substrate so that the metal impinges on the substrate at relatively high velocity and in a molten state.

The bonding of grit to a substrate with electric arc sprayed metal has been found to provide many advantages over other expedients. These advantages include ease of bonding, no cure time, greater non-skid properties, higher melt points, more ductile coating and more corrosion resistance even after initial wipe-off through use.

In one preferred embodiment of the invention, a slip resistant non-skid surface is applied to a substrate using a method comprising:

(a) cleaning the surface of the substrate;

(b) roughening the surface of the substrate;

(c) manually applying at least one base coat of metal to the substrate;

(d) manually wetting the surface of the substrate with a surfactant;

(e) manually spreading grit onto the wetted surface of the substrate;

(f) manually applying at least one bond coat of metal over the grit and the substrate, locking the grit in place; and, (g) manually applying at least one finish coat of metal over the grit and the substrate.

The substrate may be made of a material selected from the group comprising metal, fabric, plastic and concrete. Preferably, the substrate is made of a metal selected from the group consisting of steel and aluminum. Alternatively, the substrate may preferably be made of concrete.

The surface of the substrate to be treated is preferably cleaned to remove dirt, grease or other contaminants. Specifically, the surface of the substrate may be cleaned by any method available for example with soap solutions, wettng agents, steam or degreasing agents.

The surface of the substrate to be treated is preferable roughened by grit blasting, sand blasting, or by similar means.

The at least one base coat of metal may be applied to the substrate using a conventional electric arc metal spray apparatus. Metal wire is fed to the apparatus where it is melted through exposure to an electric arc. Pressurized gas preferably pressurized air, is used to project the molten metal from the apparatus toward the target. As discussed above, multiple operating parameters of the apparatus may be varied to achieve the desired results.

The wire fed to the apparatus during the base coating step may be made of a metal selected front the group of metals consisting of aluminum, steel, zinc, their alloys and any other metal desired. The same or a different metal may be used in forming each of the base, bond and finish coats.

For the base coat, the wire feed rate is between about 20 and 45 inches per minute. The apparatus, during the application of the base coat, is preferably positioned about 2 to 12 inches from the substrate. The atomizing gas, preferably air, is preferably supplied to the apparatus at a pressure of about 75 to about 100 pounds per square inch. The electricity is preferably supplied to the apparatus at 20 to 30 volts and 200 to 330 amperes when the wire has a diameter between 0.0625 to 0.250 inches.

In any event, the base coat should uniformly cover the surface of the substrate to be treated without filling in all of the contours and depressions in said surface. Preferably, the base coat should have a thickness of about 1 to 3 mils.

While essentially any surfactant may be used under the process of the invention, the surfactant is preferably selected from the group of surfactants consisting of water based adhesives, water based detergents, soaps and water. The surfactant is used to help adhere the grit to the surface of the substrate during application of the bond coat. The surfactant should be applied to the substrate in sufficient volume to wet the entire surface of the substrate to be treated.

The grit is preferably spread onto the wetted surface of the substrate. The grit may be composed of any material which has a particle size sufficient to provide the desired level of slip resistance to the finished product and which has a compressive strength sufficient to with stand the load which the substrate is intended to carry. The grit material must also have a sufficiently high melting point such that the grit does not substantially deform during the application of the at least one bond coat and the at least one finish coat.

Preferred grit materials include sized aluminum oxide, steel, glass, stone, carborundum, and mixtures thereof. The grit preferably has a particle size between 50 to 12 mesh.

The at least one bond coat of metal may be applied to the substrate using a conventional hand held electric arc metal spray apparatus. Preferably, the wire feed rate is between about 20 and 45 inches per minute. The apparatus, during the application of the bond coat, is preferably positioned about 12 to 48 inches from the substrate. The atomizing gas, preferably air, is preferably supplied to the apparatus at a pressure of about 20 to about 45 pounds per square inch. The electricity is preferably supplied to the apparatus at 20 to 35 volts and 200 to 330 amperes when the wire has a diameter between about 0.0625 to about 0.250 inches.

In any event, the bond coat should uniformly cover the surface of the substrate to be treated and the grit without filling in the interstices between the individual grit particles on the surface of the substrate. Preferably, the bond coat should have a thickness of about 1 to 3 mils.

The at least one finish coat of metal may be applied to the substrate using a conventional hand held electric arc metal spray apparatus. The material of construction of the metal wire for use in applying the finish coat should be selected depending upon the environment in which the substrate will be used. The metal used in the finish coat may be different from that used for the base coat and/or the bond coat.

The apparatus, during the application of the finish coat, is preferably positioned about 2 to 12 inches from the substrate. The atomizing gas, preferably air, is preferably supplied to the apparatus at a pressure of about 75 to about 100 pounds per square inch. The electricity is preferably supplied to the apparatus at 20 to 35 volts and 200 to 330 amperes when the wire has a diameter between about 0.0625 to about 0.250 inches.

In any event, the finish coat should uniformly cover the surface of the substrate to be treated without filling in all of the contours and depressions in said surface. For most uses, when using grit of 6 to 14 mesh size, the finish coat should have a thickness of between about between about 3 to 5 mils.

This invention disclosure incorporates by reference herein all of the U.S. patents and publications mentioned above in their entireties.

The invention having been disclosed in connection with the foregoing embodiments, additional embodiments will now be apparent to persons skilled in the art. The invention is not intended to be limited to the embodiments specifically mentioned, and accordingly reference should be made to the appended claims rather than the foregoing discussion, to assess the spirit and scope of the invention in which exclusive rights are claimed.

What is claimed is:

1. A method for producing a non-skid surface on a substrate, comprising:

(a) manually applying at least one base coat of metal to a surface of a substrate;

(b) manually wetting the surface of the substrate with a surfactant;

(c) manually spreading grit onto the wetted surface of the substrate;

(d) manually applying at least one bond coat of metal over the grit and the substrate; and, (e) manually applying at least one finish coat of metal over the grit and the substrate.

2. The method of claim 1, wherein the substrate is made from a material selected from the group comprising metal, fabric, plastic, and concrete.

3. The method of claim 1, wherein the substrate is made from concrete.

4. The method of claim 1, wherein the substrate is made from a metal selected from the group comprising of steel and aluminum.

5. The method of claim 1, wherein the surfactant is selected from the group comprising water based adhesives, water based detergents, soaps and water.

6. The method of claim 1, wherein the surfactant is applied in a sufficient volume to wet a surface of the substrate to facilitate adhesion of the grit to said surface before and during the application of a first at least one bond coat.

7. The method of claim 1, wherein the grit is selected from the group comprising sized aluminum oxide, steel, glass, stone, carborundum, and mixtures thereof.

8. The method of claim 7, wherein the grit has an average particle size of from 50 to 12 mesh.

9. The method of claim 1, wherein the at least one base coat is applied to the substrate using a conventional electric arc metal spray gun apparatus wherein wire having a diameter between 0.0625 and 0.250 inches is used with a wire feed rate between 20 and 45 inches per minute, an atomizing gas pressure between 75 and 100 pounds per square inch, and a electricity supply between 20 and 30 volts and 200 to 330 amps and wherein the gun apparatus is positioned between 2 and 12 inches from the substrate.

10. The method of claim 9, wherein the wire is made of metal.

11. The method of claim 9, wherein the wire is made of a metal selected from the group comprising of aluminum, steel and zinc.

12. The method of claim 11, wherein the wire is made of a metal selected from the group comprising carbon steel and stainless steel.

13. The method of claim 1, wherein the at least one bond coat has a thickness sufficient to lock the grit to the substrate during the application of the at least one finish coat.

14. The method of claim 13, wherein the at least one bond coat is applied to the substrate using a conventional electric arc metal spray gun apparatus wherein wire having a diameter between 0.0625 and 0.250 inches is used with a wire feed rate between 20 and 45 inches per minute, an atomizing gas pressure between 20 and 45 pounds per square inch, and an electricity supply between 20 and 35 volts and 200 to 330 amps and wherein the gun apparatus is positioned between 12 and 48 inches from the substrate.

15. The method of claim 14, wherein the wire is made of metal.

16. The method of claim 14, wherein the wire is made of a metal selected from the group comprising aluminum, steel and zinc.

17. The method of claim 16, wherein the wire is made of a metal selected from the group consisting of carbon steel and stainless steel.

18. The method of claim 1, wherein the at least one finish coat is applied to the substrate using a convention electric arc metal spray gun apparatus wherein wire having a diameter between 0.0625 and 0.250 inches is used with a wire feed rate between 20 and 45 inches per minute, an atomizing gas pressure between 75 and 100 pounds per square inch, and an electricity supply between 20 and 35 volts and 200 to 330 amps and wherein the gun apparatus is positioned between 2 and 12 inches from the substrate.

19. The method of claim 18, wherein the wire is made of metal.

20. The method of claim 18, wherein the wire is made of a metal selected from the group comprising aluminum, steel and zinc.

21. The method of claim 20, wherein the wire is made of a metal selected from the group consisting of carbon steel and stainless steel.

22. A method for applying a non-skip surface on a substrate in the field, comprising:

(a) cleaning a surface of a substrate;

(b) roughening the surface of the substrate;

(c) applying at least one base coat of metal to the substrate;

(d) wetting the surface of the substrate with a surfactant;

(e) spreading grit onto the substrate;

(f) applying at least one bond coat of metal over the grit and the substrate locking the grit in place; and, (g) applying at least one finish coat of metal over the grit and the substrate.

* * * * *